US010236604B2

(12) United States Patent
Lappoehn

(10) Patent No.: US 10,236,604 B2
(45) Date of Patent: Mar. 19, 2019

(54) PLUG CONNECTOR FOR FLEXIBLE CONDUCTOR FILMS

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/531,067

(22) PCT Filed: Nov. 12, 2015

(86) PCT No.: PCT/DE2015/100485
§ 371 (c)(1),
(2) Date: May 26, 2017

(87) PCT Pub. No.: WO2016/082822
PCT Pub. Date: Jun. 2, 2016

(65) Prior Publication Data

US 2017/0331207 A1 Nov. 16, 2017

(30) Foreign Application Priority Data

Nov. 27, 2014 (DE) ..... 10 2014 117 469
Jan. 13, 2015 (DE) ..... 10 2015 100 401

(51) Int. Cl.
*H01R 11/20* (2006.01)
*H01R 12/68* (2011.01)
(Continued)

(52) U.S. Cl.
CPC ..... *H01R 12/68* (2013.01); *H01R 12/675* (2013.01); *H01R 12/778* (2013.01);
(Continued)

(58) Field of Classification Search
CPC ..... H01R 12/68; H01R 12/778; H01R 12/00; H01R 12/24; H01R 9/00; H01R 13/5045;
(Continued)

(56) References Cited

U.S. PATENT DOCUMENTS 3,816,818 A * 6/1974 Meier ..... H01R 4/245 439/412
3,820,055 A * 6/1974 Huffnagle ..... H01R 12/675 439/400
(Continued)

FOREIGN PATENT DOCUMENTS

DE 29 07 888 A1 9/1980
DE 199 53 646 B4 12/2005
(Continued)

OTHER PUBLICATIONS

Flat Flexible Cable. Jul. 7, 2017. en.wikipedia.org.*
(Continued)

*Primary Examiner* — Amy C Johnson
*Assistant Examiner* — Milagros Jeancharles
(74) *Attorney, Agent, or Firm* — Collard & Roe, P.C.

(57) ABSTRACT

A plug connector for flexible conductor films having film-insulated conductors, includes a plug connector housing in which at least one plug contact element is arranged, and a connection region in which blades electrically conductively connected to the at least one plug contact element penetrate and fix at least one film-insulated conductor and produce an electrical contact. The plug connector housing includes two housing parts which can be pushed into one another, of which the first housing part supports the blades and the at least one plug contact element electrically conductively connected thereto, and the second housing part receives and supports the flexible conductor film and has the at least one blade receptacle which is adapted to the blades and whose
(Continued)

Figure 1:
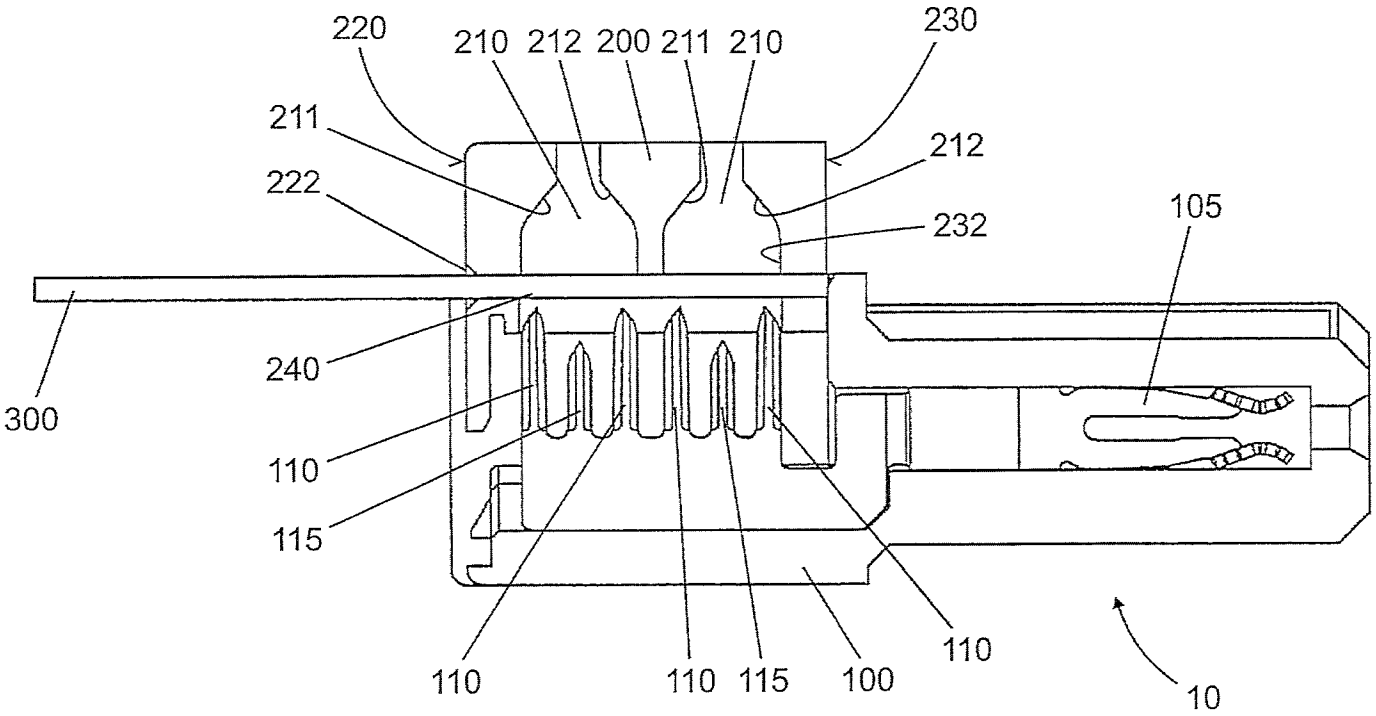

boundary surfaces are designed such that the at least a part of the blades is bent towards the film-insulated conductor when the two housing parts are pushed into one another.

16 Claims, 7 Drawing Sheets

(51) Int. Cl.

| | |
|---|---|
| ***H01R 12/67*** | (2011.01) |
| ***H01R 12/77*** | (2011.01) |
| ***H01R 13/504*** | (2006.01) |
| ***H01R 13/52*** | (2006.01) |
| *H01R 4/2404* | (2018.01) |
| *H01R 4/2495* | (2018.01) |
| *H01R 4/2433* | (2018.01) |

(52) U.S. Cl.
CPC ..... *H01R 13/5045* (2013.01); *H01R 13/521* (2013.01); *H01R 4/2404* (2013.01); *H01R 4/2433* (2013.01); *H01R 4/2495* (2013.01)

(58) Field of Classification Search
CPC ..... H01R 13/506; H01R 13/42; H01R 13/58; H01R 23/27; H01R 23/66; H01R 24/84; H01R 33/00; H01R 33/06; H01R 4/2495; H01R 4/2433; H01R 4/2404
USPC ..... 439/67, 74, 77, 387–397, 449, 459, 460, 439/470, 499, 586, 593, 731, 751, 752.5, 439/858, 404, 405, 417, 422
See application file for complete search history.

(56) References Cited

U.S. PATENT DOCUMENTS

| | | | | |
|---|---|---|---|---|
| 4,068,912 | A * | 1/1978 | Hudson, Jr. | H01R 12/675 29/857 |
| 4,088,382 | A * | 5/1978 | Ichimura | H01R 4/245 439/397 |
| 4,089,580 | A * | 5/1978 | Huffnagle | H01R 4/2445 439/400 |
| 4,209,219 | A * | 6/1980 | Proietto | H01R 12/675 439/405 |
| 4,270,831 | A * | 6/1981 | Takahashi | H01R 12/675 439/397 |
| 4,359,257 | A * | 11/1982 | Lopinski | H01R 12/675 439/405 |
| 5,423,120 | A * | 6/1995 | Kaneko | H01R 43/16 29/874 |
| 6,394,833 | B1 * | 5/2002 | Bulmer | H01R 12/675 439/393 |
| 6,851,965 | B1 | 2/2005 | Czabanski et al. | |
| 7,273,388 | B2 | 9/2007 | Kumakura | |
| 7,338,310 | B2 | 3/2008 | Kumakura | |
| 2006/0199423 | A1 * | 9/2006 | Yamanashi | H01R 4/242 439/417 |
| 2008/0076295 | A1 * | 3/2008 | Lappoehn | H01R 4/2433 439/499 |
| 2010/0167579 | A1 * | 7/2010 | Hayauchi | H01R 4/2433 439/426 |
| 2010/0227496 | A1 * | 9/2010 | Sticker | H01R 13/506 439/417 |
| 2012/0058667 | A1 * | 3/2012 | Carreras Garcia | H01R 4/2433 439/395 |
| 2012/0282785 | A1 * | 11/2012 | Lownds | H01R 4/2433 439/31 |
| 2012/0322294 | A1 * | 12/2012 | Lappoehn | H01R 4/2433 439/397 |
| 2017/0373405 | A1 * | 12/2017 | Lappoehn | H01R 4/2433 |

FOREIGN PATENT DOCUMENTS

| | | | |
|---|---|---|---|
| DE | 10 2006 017 019 | A1 | 11/2006 |
| DE | 10 2006 013781 | A1 | 11/2006 |
| FR | 2 956 780 | A1 | 8/2011 |
| JP | 2014 086169 | A | 5/2014 |

OTHER PUBLICATIONS

International Search Report of PCT/DE2015/100485, dated Mar. 30, 2016.
German Office Action in DE 10 2015 100 401.1, dated Sep. 21, 2015, with English translation of relevant parts.

* cited by examiner

PLUG CONNECTOR FOR FLEXIBLE CONDUCTOR FILMS

CROSS REFERENCE TO RELATED APPLICATIONS

This application is the National Stage of PCT/DE2015/100485 filed on Nov. 12, 2015, which claims priority under 35 U.S.C. § 119 of German Application Nos. 10 2014 117 469.0 filed on Nov. 27, 2014 and 10 2015 100 401.1 filed on Jan. 13, 2015, the disclosures of which are incorporated by reference. The international application under PCT article 21(2) was not published in English.

The invention relates to a plug connector for flexible conductor films having film-insulated conductors.

PRIOR ART

Flexible conductor films having film-insulated conductors are used today in various fields of entertainment and consumer electronics, but also in the field of vehicle construction. Conductor films are used, in particular, where a very flexible conductor structure is desired with minimum weight and limited spatial conditions. Flexible conductor films allow ordered parallel guidance of a multitude of separate conductive paths, wherein even larger bends are possible and thus parts that are arranged in a very limited installation space can be electrically conductively connected to each other. Particularly in the field of vehicle construction, such conductor films must also be able to resist greater mechanical impacts such as, e.g., vibrations.

Here, particular significance is attached to the contact of the individual film-insulated conductors. Particularly in the field of vehicle construction, this contact must be secure and formed to be resistant to external mechanical impacts and also, different kinds of temperature and environmental influences.

The contact of a flexible conductor film having film-insulated conductors emerges from FR 2 956 780, in which the individual film-insulated conductors are pierced by blade-like points and these points, after they have pierced the conductive paths, are bent in such a way that they firmly clamp and hold the flexible conductor film while at the same time contacting the corresponding conductive paths. This is done by means of crimp technology. The blades are, in turn, electrically conductively connected to plug connectors wherein a plug connector is assigned to each film-insulated conductor, which is contacted via several blades. After contacting the film-insulted conductors, which can also be undertaken automatically in continuous operation, the plug connectors contacted in this way must be installed in plug connector housings, which requires additional installation steps irrespective of the contact. Because of this, the installation of plug connectors of this type is time-consuming, which is disadvantageous particularly in terms of automated installation.

From DE 199 53 646 B4, a plug connector for flexible conductor films having film-insulated conductors with a plug and a mating plug emerges, which are respectively provided on a conductor film end portion and can be pushed into one another for the purpose of electrically contacting the film-insulated conductors. For this purpose, the plug and the mating plug each have a base body and a cover, which can be brought into fixed contact with the base body via a fixing mechanism. In each case, at least one penetrating contact element is provided between the base body and the cover, said penetrating contact element providing at least one base plate of electrically conductive material with penetrating bodies. The penetrating bodies are triangular moulds formed from the base plate material, each with a triangle apex protruding from the base plate and a triangular base positioned opposite the triangle apex in the base plate, around which each mould is bent. A multitude of penetrating bodies are provided in the base plate, the triangular basis of which respectively forms an angle with the longitudinal axis of the base plate in such a way that the penetrating bodies, relative to the longitudinal axis of the base plate, are arranged one behind the other, respectively alternately having an angle of ±60°. A film-insulated conductor of the conductor film end portion can be arranged on the penetrating contact element before bringing the cover into contact with the base body, wherein said penetrating contact element at least partially penetrates the film-insulated conductor for purposes of fixing the electrical contact by means of crimping each of the covers against the base body. Even in the case of this plug connection, several unrelated installation steps are necessary, for contacting on the one hand the individual film-insulated conductors of the flexible conductor film, and on the other hand, the film-insulated conductors connected with the plug connectors in this way in a plug connector housing.

Automatic production is also not possible here without further measures being taken.

SUMMARY OF THE INVENTION

In contrast, the plug connector for flexible conductor films according to the invention described herein has the advantage not only that a simple and, in particular, an automatic production process of accessible contacting of the film-insulated conductive paths is possible, also in particular simultaneous contacting of several conductive paths arranged side by side in the flexible conductor film while simultaneously installing the plug connector in the plug connector housing, but also in particular very effective, electrically excellent and gas-tight contact of the corresponding plug contacts can be realized, which also withstands mechanical loads and therefore e.g. can also be used in car construction.

This excellent gas-tight contact is realised by bending the blades in the direction of the film-insulated conductor. By bending said blades, a pressure is exerted on the contact surface and the electrical contact surface increases in size. In this way, a gas-tight contact is realised. At the same time, the blades are held under a certain tension in the plug connector housing. The production of electrical contacts by the electrically conductive blades connected to the plug connector takes place in a very advantageous way here at the same time as during the installation of the plug connector housing by pushing the two plug connector housing parts into one another.

Advantageous developments and improvements of the plug connector specified in the independent claim are possible by means of the measures disclosed in the dependent claims. Therefore, an advantageous embodiment provides that the second housing part has a receiving space adapted to the conductor film, said housing part having at least one opening for receiving the conductor film in at least one housing wall. In this way, the flat, flexible conductor film can be pushed into the second housing part and is held there in the receiving space which is adapted to it. The opening and the receiving space are arranged in the second housing part in such a way that a conductor film arranged in the receiving space comes to lie substantially perpendicular to the blades. In this way, an installation pre-positioning of the flexible conductor film in the second housing part can be realised by pushing the flexible conductor film into the second housing part, since the flexible conductor film is thus already arranged in the second housing part in an initial position that allows direct and also automatic contacting of the film-insulated conductors.

It is advantageously provided that the blade receptacles have curved boundary surfaces.

These boundary surfaces are additionally preferably formed as sliding surfaces for at least one part of the blades.

Here, it is very advantageously provided that the boundary surfaces that form the sliding surfaces run in such a funnel-shaped way that two blades are bent towards each other while they slide along the boundary surface. This formation of the blade receptacles adapted to the blades allows optimum gas-tight contact of the film-insulated conductors with the at least one plug contact during the installation of the second plug contactor housing part on the first plug contactor housing part.

This installation can particularly also be carried out in an automated way.

According to an advantageous embodiment, it is here provided that the blades are arranged one behind the other along a line in such a way that, during the installation of the second plug connector housing part onto the first plug connector housing part, a film-insulated conductor is penetrated at several points.

A very advantageous embodiment here provides that the blades are of different lengths, wherein respectively a shorter blade is enclosed respectively by two longer blades which are spaced apart in such a way and are so long that they respectively come into contact with the boundary surfaces of each blade receptacle.

Purely in principle, such a blade receptacle having three blades, one shorter and two longer, would suffice in order to realise good, secure and in particular, gas-tight contact of the film-insulated conductors with the plug contact. A particularly advantageous embodiment, however, provides that the second housing part has several blade receptacles arranged one behind the other in the longitudinal direction of the film-insulated conductors. In this way, the contact surface and therefore the contact secureness increases. In addition to this, the ampacity of the contact produced in this way increases by means of this.

Clamping elements are provided in the first and/or second housing part for the formation of strain relief of the flexible conductor film when installed in the plug connector, said clamping elements clamping the flexible conductor film in the region between the film-insulated conductors, when the two housing parts are installed on each other.

Purely in principle, these clamping elements may be formed in very different ways and arranged in the housing parts.

An advantageous embodiment provides that the clamping elements are respectively arranged between conductive paths of the flexible conductor film.

Here, it can be provided that the clamping elements are each assigned to rows of blades.

A very advantageous embodiment provides that first clamping elements are arranged in the first housing part, and second clamping elements, which interact with the first clamping elements are arranged in the second housing part. In this way, to an extent, clamping of flexible conductor film is automatically produced during the installation of the second housing part on the first housing part.

The formation of the first and second clamping elements can here be designed very differently. An advantageous embodiment provides that the first clamping elements are clamping teeth with rounded clamping tooth surfaces, and the second clamping elements are openings adapted to the clamping teeth and arranged in the second housing element. Such a design of the clamping elements allows particularly effective and easy to produce clamping, and therefore strain relief of the flexible conductor film in the plug connector housing part.

Here it is advantageously provided that the clamping teeth are of a height that is measured in such a way that when both housing parts are installed on each other, the flexible conductor film arranged between the first and second housing part is deformed in such a way that the deformed flexible conductor film in the region of the openings slightly protrudes into the openings arranged in the second housing part.

A very advantageous embodiment further provides that the second housing part is latchable with the first housing part.

SHORT DESCRIPTION OF THE DRAWINGS

Figure 2:
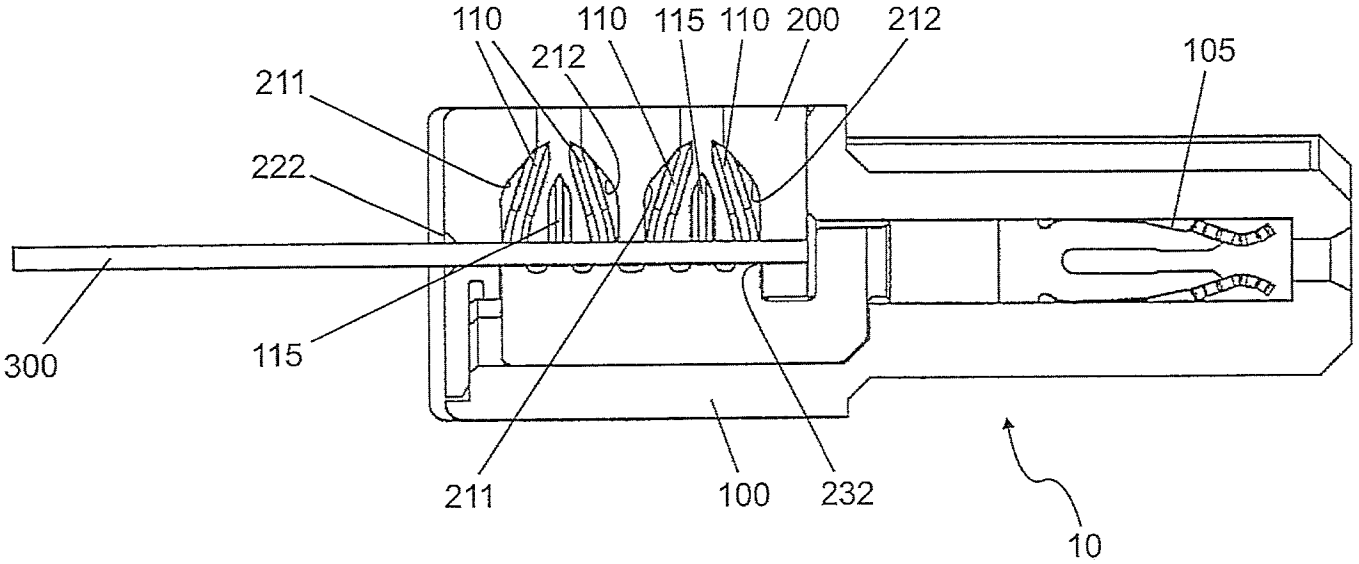
Figure 8:
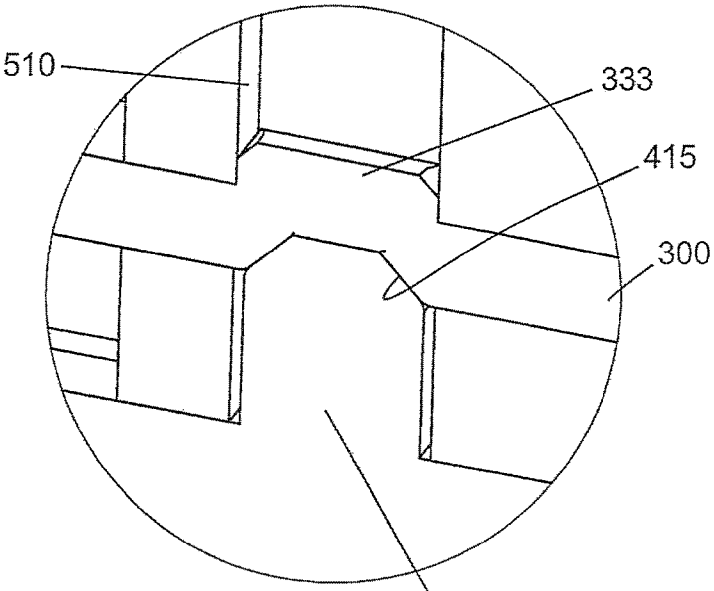
Figure 9:
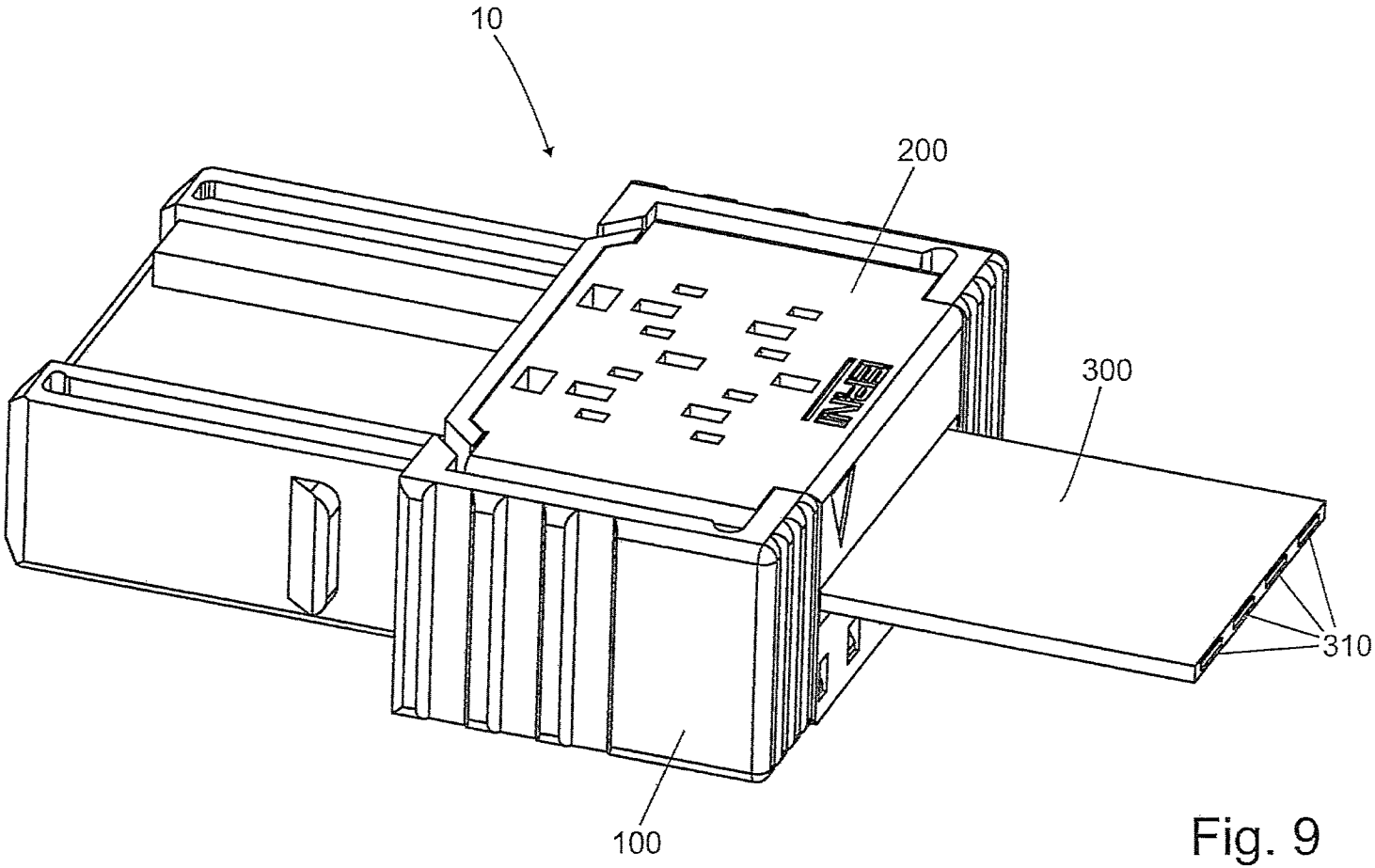

Exemplary embodiments of the invention are shown in the drawings and explained in more detail in the following description. Here are shown;

FIG. 1 a schematic sectional view of a plug connector for flexible conductor films according to the invention before installing the two housing parts:

FIG. 2 the sectional view of a plug connector according to the invention shown in FIG. 1 after the installation of the two housing parts;

FIG. 3 to FIG. 8 an isometric, partially cutaway view of successive steps of the installation of a flexible conductor film in a plug connector utilising the invention, as well as some detail enlargements, and FIG. 9 an isometric view of the complete plug connector shown in FIGS. 3 to 7.

EMBODIMENTS OF THE INVENTION

A plug connector indicated as a whole by the numeral 10 has a housing that consists of two parts. In a first plug connector housing part 100, plug contacts are arranged in the form of spring contacts 105 in an inherently known way. Blades 110, 115 are electrically connected to the plug contacts 105, said blades being arranged one behind the other in a line, wherein respectively a shorter blade 115 is enclosed by two longer blades 110.

A second plug connector housing part 200 is formed as a separate part. The second plug connector housing part 200 is formed in such a way that it is fixable on and latchable with the first plug connector housing part 100 by being pushed into a corresponding opening in it. The second plug connector housing part 200 has an opening 222 on a side wall 220, said opening being used to receive a flexible conductor film 300. There is also an opening 232 arranged in the opposite side wall 230, which is accessible from the interior of the second plug connector, more precisely from a receiving space 240 arranged in the interior and adapted to the conductor film 300. Both openings 222, 232 therefore lead into the receiving space 240 arranged in the second plug connector housing part and adapted to the conductor film 300, the dimensions of said receiving space 240 substantially corresponding to the outer dimensions of the conductor film. As can be seen in particular in FIG. 1, the opening 222 accessible outwards, in which the conductor film is inserted, is funnel-shaped in such a way that inserting the conductor film 300 into the second plug connector housing part 200 is made easier.

In addition to this, two blade receptacles 210 are provided in the second plug connector housing part 200, said blade receptacles 210 also being able to be described as blade receptacle spaces. These blade receptacles 210 have funnel-shaped bent boundary surfaces 211, 212 that are spaced apart in such a way that they are adapted to the distance of the two longer blades 110 that respectively enclose the shorter blade 115. The two longer blades 110 that enclose each of the shorter blades 115 therefore to an extent "fit" into the blade receptacles 210, wherein the longer blades 110 come into contact with the boundary surfaces 211 or 212. The state before the final installation of the second plug connector housing part 200 on the first plug connector housing part 100 is depicted in FIG. 1. The installation is now undertaken by the second plug connector housing part 200 being pushed in the direction of the first plug connector housing part 100. While this occurs, the blades 110, 115 penetrate a film-insulated conductive path of the conductor film and by doing so, contact the conductor film with the plug contact 105. While being pushed into one another, the two outer and longer blades 110 that enclose the shorter blade 115 slide onto the two boundary surfaces 211, 212 of the blade receptacles 210, wherein they are bent towards each other, as shown in FIG. 2. When fully installed, meaning that the second plug connector housing part 200 is latched on the first plug connector housing part 100, the outer blades 110 that enclose the shorter inner blade 115 are bent towards each other. Because of this bending, the two outer blades 110 cut in the direction of the conductor film and by doing so, not only enlarge the contact surface and therefore increase the contact secureness, and also the ampacity, but are also pre-tensioned. Through this, a pressure is exerted on the contact surfaces and this in turn allows gas-tight contact. In this way, this type of contact allows electrical contact that is able to resist external influences, in particular mechanical loads, and that—and this is to be particularly emphasised—can also take place automatically.

Figure 3:
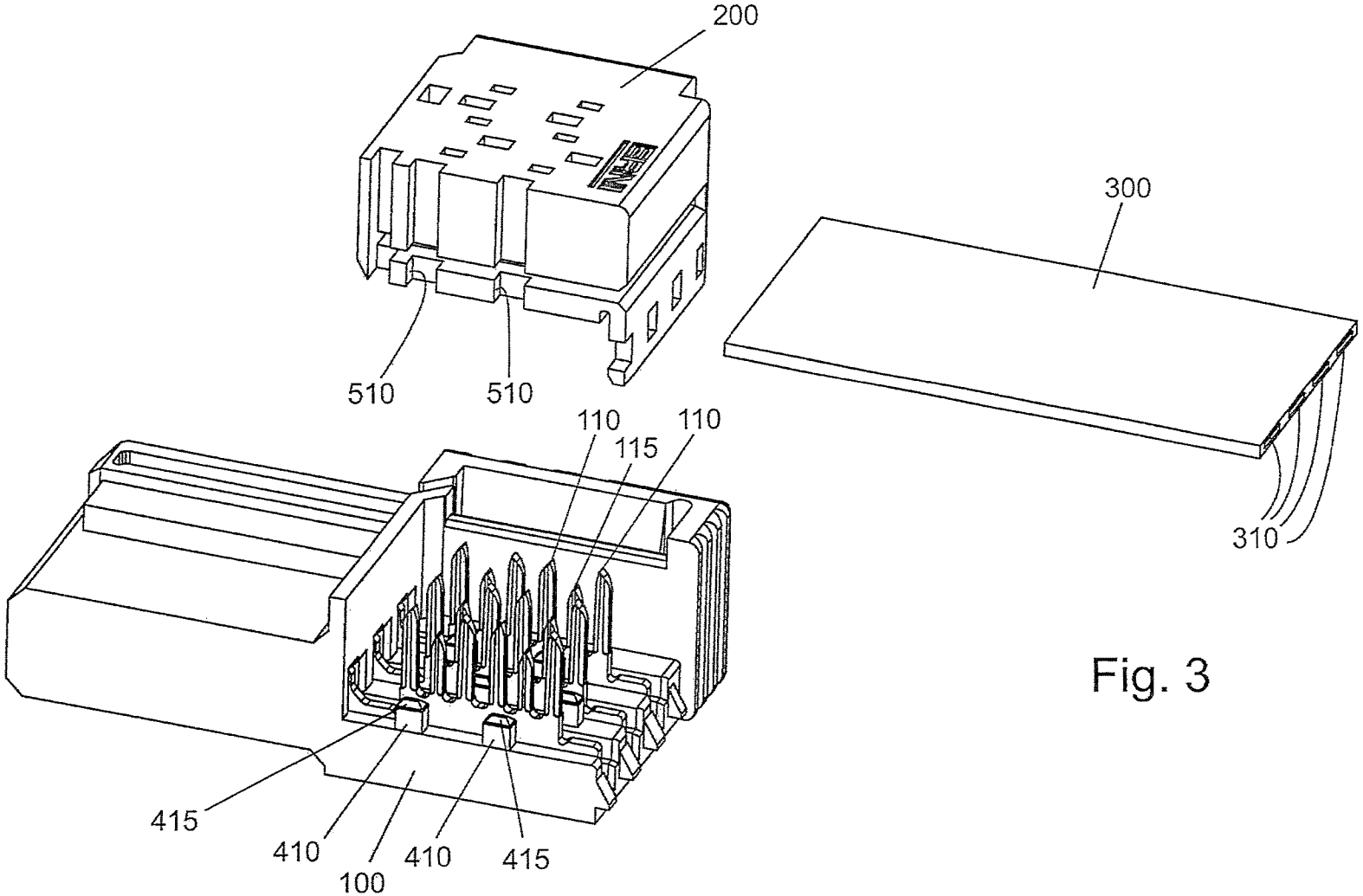
Figure 4:
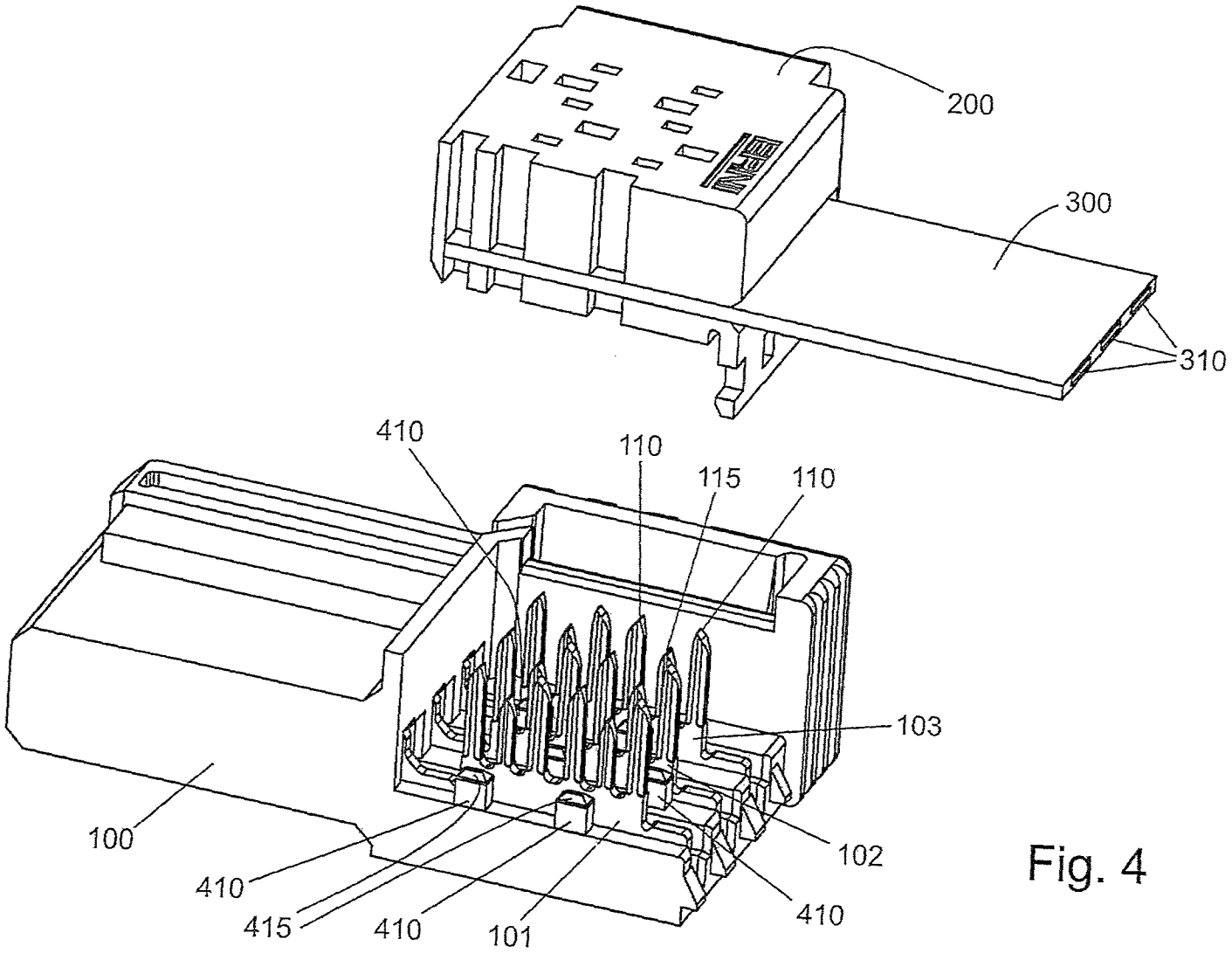

In FIG. 3, 4, 5, 7, different steps of installing the flexible conductor film 300 are shown in an isometric and partially cutaway view. FIG. 9, shows the flexible conductor 300 in a completely installed plug connector, i.e. after the fixing of the housing part 200 onto the housing part 100 by the formation of electrical contact of film-insulated conductors 310 of the conductor film 300 and fixing the conductor film 300 in the manner described above.

To realise strain relief and secure fixing of the flexible conductor film 300 in the plug connector housing, formed from the first housing part 100 and the second housing part 200 fixed to this, fixing elements in the form of clamping teeth 410 are provided in the first housing part, which have rounded clamping tooth surfaces 415. These clamping teeth 410 are each positioned in the spaces between the film-insulated conductors 310, in order to clamp the flexible conductor foil 300 there. As can be seen in FIG. 3, the film-insulated conductors 310 are arranged side by side in the flexible conductor film 300. Blades 110, 115 are, in each case, assigned to each film-insulated conductor 310, in order to contact the film-insulated conductors 310 and to clamp them. Clamping teeth 410 are assigned to each row of blades 110, 115. The clamping teeth 410 therefore lie between the blades 110, 115, approximately in the region of the flexible conductor film 300, in which no film-insulated conductor 310 is arranged. In FIG. 3, respectively three rows of blades 110, 115 and rows of clamping teeth, which are also arranged one behind the other and run substantially in parallel to the rows of the blades 110, 115 are shown. It is understood that four such rows are provided for the flexible conductor film 300 shown in FIG. 3, the fourth row is, however, cutaway and therefore not shown for the purpose of clarity. This also applies to FIGS. 4, 5 and 7.

In the second housing part 200, the clamping teeth 410 are respectively provided with assigned openings 510, which are adapted to the clamping teeth 410 in such a way that the clamping teeth can be received by these openings 510.

Firstly, the conductor film 300 is installed in the second housing part 200 by inserting it in the receiving space 240 in the manner described above. This is shown schematically in FIG. 4.

Thereafter, the second housing part 200 is moved in the direction of the first housing part 100. Here, the electric contact is produced in the manner also described above, by the blades 110, 115 penetrating the film-insulated conductive paths 310 and then being bent in the direction of the film-insulated conductors 310, i.e. in the direction of the conductors.

Figure 6:
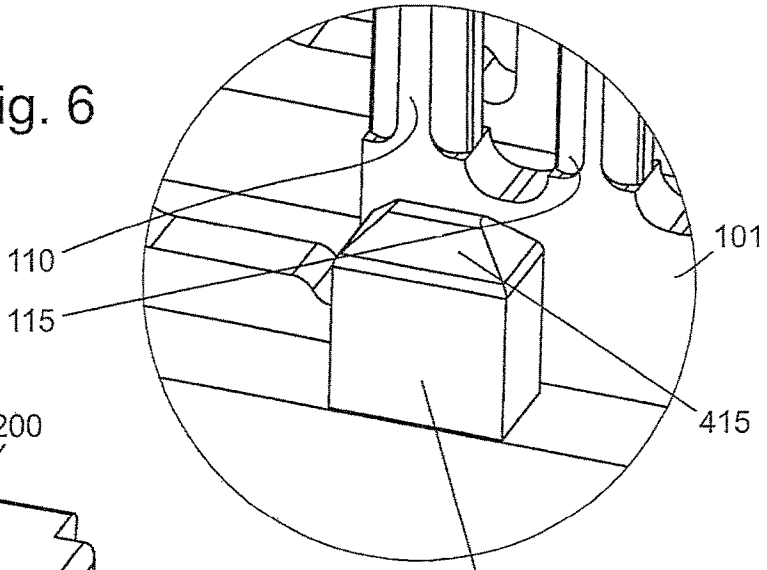
Figure 5:
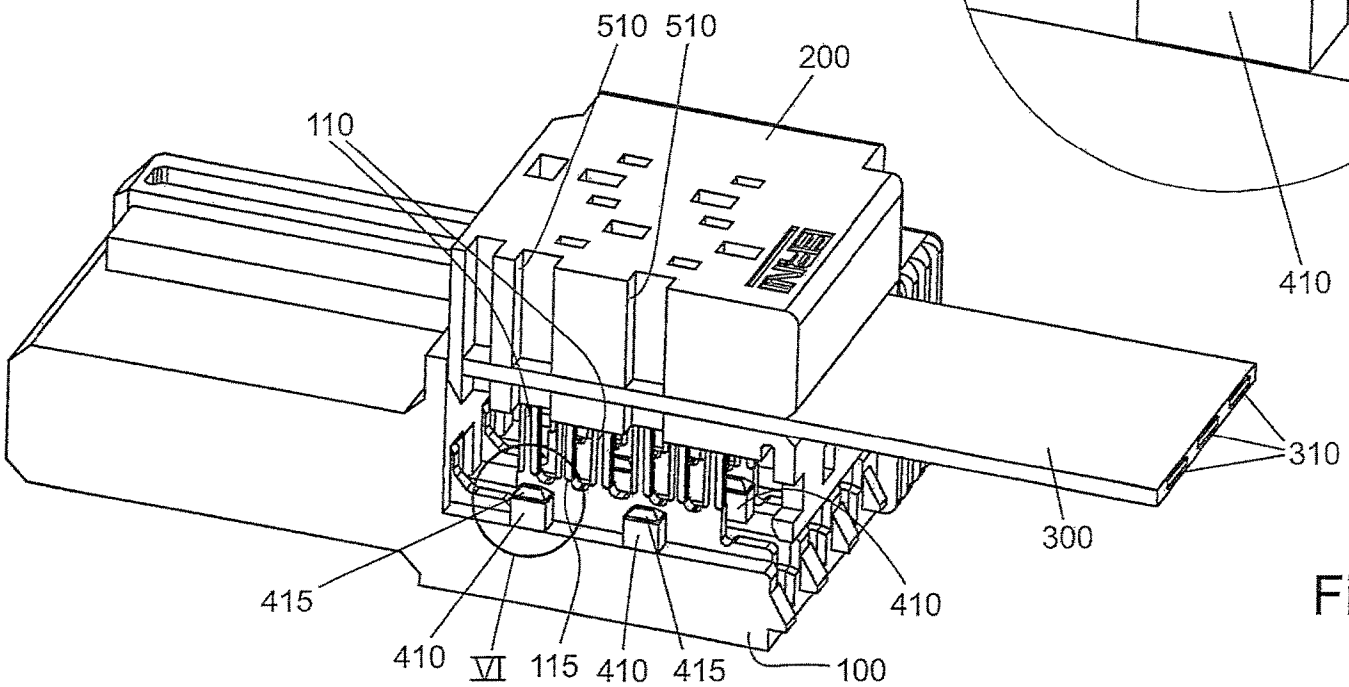

This step is schematically depicted in FIG. 5. FIG. 6 shows an enlargement of the cut-out shown in FIG. 5 indicated with VI. In particular, it is shown in this enlargement how the clamping tooth surfaces 415 of the clamping teeth 410 are formed tapering upwards in the manner of a roof. The invention is of course not limited to this, clamping teeth that are rounded or tapered upwards in a different way can also be provided. This tapering is used for optimum clamping of the flexible conductor foil 300. This clamping is schematically shown in FIG. 7 and FIG. 8, which shows an enlargement of the cut-out shown in FIG. 7 indicated with VIII.

Figure 7:
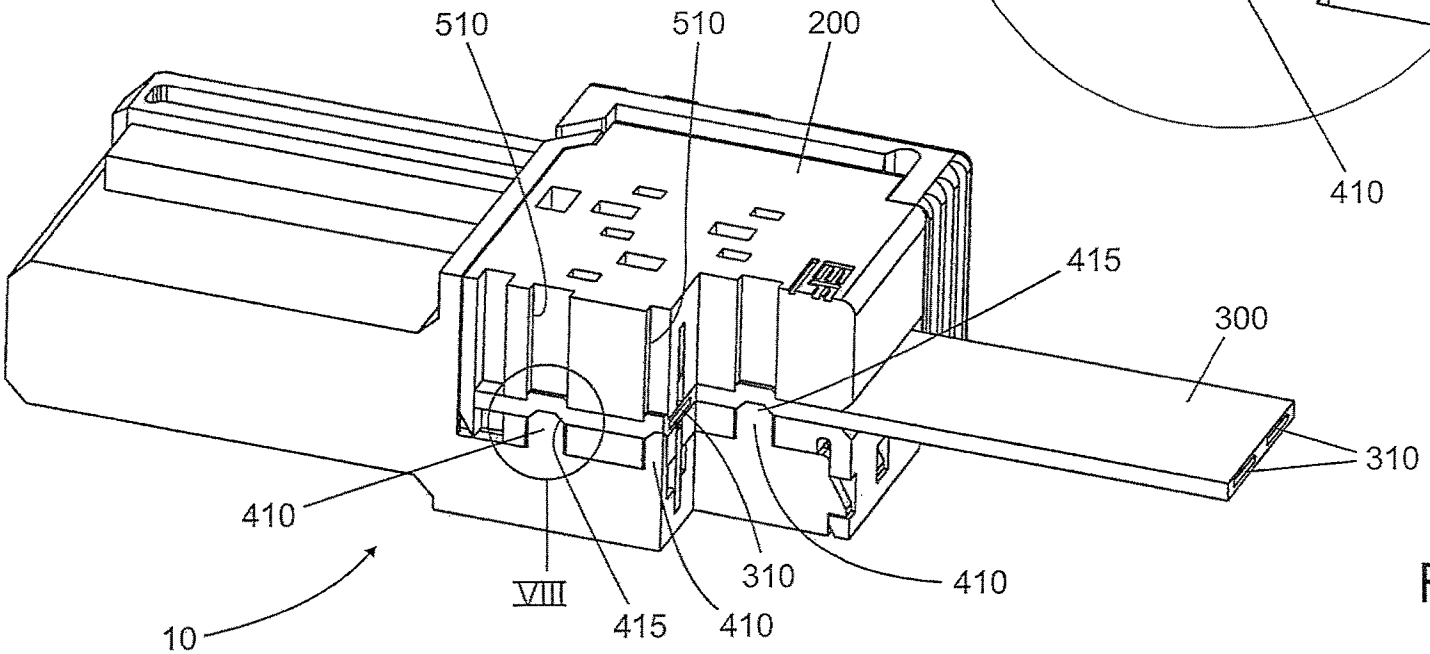

FIG. 7 shows the completely installed plug connector with flexible conductor film 300. The isometric depiction is cut in two planes in order to clearly show how not only the blades 110, 115 respectively run in rows parallel to the film-insulated conductors 310 over these, but also are assigned thereto and are also arranged in rows running parallel to the film-insulated conductors 310. The clamping teeth 410 slightly deform the conductor film 300 with their upwardly tapering regions 415, wherein the deformed regions 333 slightly protrude into the opening 510 that is provided in the second housing part 200. For this purpose, the clamping teeth 410 are of a height that is measured in such a way that, when the two housing parts are installed on one another, the flexible conductor film 300 arranged between the first and second housing part is deformed in such a way that the deformed regions 333 of the flexible conductor film 300 slightly protrude into the openings 510, as is shown in FIGS. 7 and 8. This type of clamping takes place in an evenly distributed manner across the entire conductor film 300, whereby a very stable fixing of the conductor film 300 by forming strain relief emerges.

The fully installed plug connector in its complete state, i.e. without partly cutaway sections, is shown in FIG. 9.

The interaction of the contact by the blades 110, 115 with the clamping by the clamping teeth 410 allows very good, reliable, long-lasting and stable fixing and contacting of a flexible conductor film in a plug connector in the case of simple installation.

The invention claimed is:

1. Plug connector for flexible conductor films having film-insulated conductors, the plug connector comprising a plug connector housing in which at least one plug contact element is arranged, the plug connector housing comprising a connection region in which blades which are electrically conductively connected to the at least one plug contact element penetrate and fix at least one film-insulated conductor by producing electrical contact, wherein the plug connector housing comprises a first housing part and a second housing part that can be pushed into one another, wherein the first housing part supports the blades and the at least one plug contact element electrically conductively connected thereto, wherein the second housing part receives and supports the flexible conductor film, has at least one blade receptacle adapted to the blades, and has a receiving space adapted to the conductor film, the receiving space having two aligned openings in two housing walls situated opposite each other for receiving the conductor film, wherein the at least one blade receptacle comprises boundary surfaces bent such that at least a part of the blades is bent and pretensioned in a direction of the film-insulated conductor when the first and second housing parts are pushed into one another, and wherein the at least one part of the blades remains bent and fully pretensioned in a fully installed state of the first and second housing parts.

2. Plug connector according to claim 1, wherein the two aligned openings are arranged in such a way that a conductor film arranged in the receiving space comes to lie substantially perpendicular to the blades.

3. Plug connector according to claim 1, wherein the boundary surfaces of the blade receptacles form sliding surfaces for at least a part of the blades.

4. Plug connector according to claim 3, wherein the boundary surfaces of the blade receptacles run in such a funnel-shaped way that two blades are bent towards each other while they slide along the boundary surfaces.

5. Plug connector according to claim 1, wherein the blades are arranged in such a way one behind the other along a line that, during the installation of the second housing part on the first housing part, a film-insulated conductor is penetrated in several sections.

6. Plug connector according to claim 5, wherein the blades are of different lengths, and wherein respectively a shorter blade is respectively enclosed by two longer blades which are spaced apart in such a way and are so long that they come into contact with the boundary surfaces of the at least one blade receptacle.

7. Plug connector according to claim 1, wherein the second housing part has several blade receptacles arranged one behind the other in the longitudinal direction of the film-insulated conductor.

8. Plug connector according to claim 1, wherein clamping elements are provided in the first and/or second housing part, which clamp the flexible conductor film in the region between the film-insulated conductors, when the two housing parts are installed on each other.

9. Plug connector according to claim 8, wherein the clamping elements are arranged between the conductive paths of the flexible conductor film.

10. Plug connector according to claim 9, wherein the clamping elements are respectively assigned to rows of blades.

11. Plug connector according to claim 8, wherein first clamping elements are arranged in the first housing part, and second clamping elements, which interact with the first clamping elements, are arranged in the second housing part.

12. Plug connector according to claim 11, wherein the first clamping elements are clamping teeth with clamping tooth surfaces extending in the direction of the flexible conductor film, and wherein the second clamping elements are openings arranged in the second housing element and adapted to the clamping teeth.

13. Plug connector according to claim 12, wherein the clamping teeth are of a height that, when the two housing parts are installed on each other, deforms the flexible conductor film arranged between the first and the second housing part in such a way that the deformed regions of the flexible conductor film slightly protrude into the openings arranged in the second housing part.

14. Plug connector according to claim 1, wherein the second housing part is latched to the first housing part when installed.

15. Plug connector according to claim 1, wherein the second housing part comprises a through-hole extending through the second housing part, and wherein starting from the bent boundary surfaces of the at least one blade receptacle the through-hole extends linearly to an outer surface of the second housing part.

16. Plug connector according to claim 1, wherein the boundary surfaces are bent such that the at least a part of the blades is bent and pretensioned in a longitudinal direction of the film-insulated conductor when the first and second housing parts are pushed into one another.

* * * * *